US010380834B2

(12) United States Patent
Litman

(10) Patent No.: US 10,380,834 B2
(45) Date of Patent: Aug. 13, 2019

(54) REPLACEABLE FLEXIBLE ELECTRONIC TABLE TOP WITH DISPLAY FUNCTION FOR GAMING TABLES

(71) Applicant: Mark A. Litman, Edina, MN (US)

(72) Inventor: Mark A. Litman, Edina, MN (US)

( * ) Notice: Subject to any disclaimer, the term of this patent is extended or adjusted under 35 U.S.C. 154(b) by 0 days.

(21) Appl. No.: 16/196,020

(22) Filed: Nov. 20, 2018

(65) Prior Publication Data

US 2019/0088071 A1 Mar. 21, 2019

Related U.S. Application Data

(63) Continuation-in-part of application No. 15/990,726, filed on May 28, 2018, and a continuation-in-part of application No. 14/829,800, filed on Aug. 19, 2015, now Pat. No. 10,134,235, and a continuation-in-part of application No. 14/805,863, filed on Jul. 22, 2015.

(51) Int. Cl.

| | |
|---|---|
| ***G07F 17/32*** | (2006.01) |
| ***A63F 1/06*** | (2006.01) |
| ***A63F 3/00*** | (2006.01) |
| ***A63F 1/00*** | (2006.01) |

(52) U.S. Cl.

CPC ..... *G07F 17/322* (2013.01); *A63F 1/067* (2013.01); *A63F 3/00157* (2013.01); *G07F 17/3206* (2013.01); *G07F 17/3211* (2013.01); *G07F 17/3293* (2013.01); *A63F 2001/003* (2013.01); *A63F 2003/00164* (2013.01)

(58) Field of Classification Search

CPC ..... G07F 17/322; G07F 17/3206; G07F 17/3211; G07F 17/3293; A63F 1/067; A63F 3/00157; A63F 2001/003; A63F 2003/00164

See application file for complete search history.

(56) References Cited

U.S. PATENT DOCUMENTS

| | | | |
|---|---|---|---|
| 6,117,009 | A | 9/2000 | Yoseloff |
| 6,159,096 | A | 12/2000 | Yoseloff |
| 6,688,979 | B2 | 2/2004 | Soltys |
| 6,712,696 | B2 | 3/2004 | Soltys |
| 6,758,751 | B2 | 7/2004 | Soltys |
| 6,857,961 | B2 | 2/2005 | Soltys |
| 6,964,612 | B2 | 11/2005 | Soltys |

(Continued)

*Primary Examiner* — Werner G Garner

(74) *Attorney, Agent, or Firm* — Mark A. Litman & Associates, P.A.

(57) ABSTRACT

A flexible carrier sheet enables a method of providing image content to individual ones of multiple player positions. The carrier sheet is a flexible, replaceable gaming table covering that includes a flexible carrier sheet. The flexible carrier sheet having multiple flexible electronic display panels capable of displaying distinct image content selected from the group consisting of: a) alphanumerics, b) distinct areas of light; and c) distinct areas of color, each of the multiple flexible electronic display panels provided on a top surface of the carrier sheet. One end of the electrically conductive leads goes into each one of the flexible electronic display panels. An opposite end of the electrically conductive leads having at least one connector configured to receive electronic data input so that the electrically conductive leads transmit the electronic data input to each one of the flexible electronic display panels. A dealer or sensor may initiate a command.

19 Claims, 6 Drawing Sheets

(56) References Cited

U.S. PATENT DOCUMENTS

| | | | |
|---|---|---|---|
| 6,991,544 | B2 | 1/2006 | Soltys |
| 7,011,309 | B2 | 3/2006 | Soltys |
| 7,222,852 | B2 | 5/2007 | Soltys |
| 7,317,615 | B2 | 1/2008 | Chang et al. |
| 7,390,256 | B2 | 6/2008 | Soltys |
| 7,427,234 | B2 | 9/2008 | Soltys |
| 7,510,194 | B2 | 3/2009 | Soltys |
| 7,575,234 | B2 | 8/2009 | Soltys |
| 7,758,411 | B2 | 7/2010 | Crawford, III et al. |
| 8,109,821 | B2 | 2/2012 | Kovacs |
| 8,147,316 | B2 | 4/2012 | Arezina et al. |
| 8,348,747 | B2 | 1/2013 | Arezina et al. |
| 8,403,740 | B2 | 3/2013 | Kovacs |
| 8,613,650 | B2 | 12/2013 | Kovacs |
| 8,915,786 | B2 | 12/2014 | Baerlocher |
| 8,926,421 | B2 | 1/2015 | Arezina et al. |
| 9,647,171 | B2 | 5/2017 | Rogers |
| 9,666,833 | B2 | 5/2017 | Gao |
| 9,720,449 | B2 | 8/2017 | Ko |
| 9,741,785 | B2 | 8/2017 | Bower |
| 9,761,444 | B2 | 9/2017 | Nuzzo |
| 9,765,934 | B2 | 9/2017 | Rogers |
| 9,942,979 | B2 | 4/2018 | Park |
| 2003/0008769 | A1 | 1/2003 | Garoff et al. |
| 2006/0189365 | A1 | 8/2006 | Crawford, III et al. |
| 2007/0117604 | A1 | 5/2007 | Hill |
| 2009/0189351 | A1 | 7/2009 | Baerlocher |
| 2010/0019449 | A1 | 1/2010 | Downs |
| 2010/0113120 | A1* | 5/2010 | Snow ..... G07F 17/32 463/16 |
| 2010/0130280 | A1 | 5/2010 | Arezina |
| 2011/0275432 | A1 | 11/2011 | Lutnick |
| 2012/0001913 | A1* | 1/2012 | Lee ..... G09G 5/36 345/428 |
| 2012/0010090 | A1 | 1/2012 | Nakamura et al. |
| 2012/0157193 | A1 | 6/2012 | Arezina |
| 2013/0014364 | A1 | 1/2013 | Stillwagon |
| 2014/0309017 | A1 | 10/2014 | LaDuca |
| 2014/0349726 | A1 | 11/2014 | Buchholz et al. |
| 2014/0370980 | A1 | 12/2014 | Czyzewski |
| 2015/0087417 | A1 | 3/2015 | George |
| 2016/0078709 | A1* | 3/2016 | Stanford ..... G07F 17/322 463/37 |

* cited by examiner

REPLACEABLE FLEXIBLE ELECTRONIC TABLE TOP WITH DISPLAY FUNCTION FOR GAMING TABLES

RELATED APPLICATION DATA

This application claims priority under 35 USC 120 as a continuation-in-part of U.S. patent application Ser. No. 15/990,726, filed 28 May 2018, titled ELECTRONIC TABLE GAME WITH SECONDARY RANDOM EVENT DISPLAYS, which is in turn a continuation-in-part of Ser. No. 14/829,800, filed 19 Aug. 2015, and titled SIDE BETS FOR PLAYING CARD WAGERING EVENTS WITH OPTIONAL PROGRESSIVE EVENT, now U.S. Pat. No. 10,134,235, which in turn claims priority from U.S. patent application Ser. No. 14/805,863, filed Jul. 22, 2015 and titled SIDE BETS FOR PLAYING CARD WAGERING EVENTS WITH OPTIONAL PROGRESSIVE EVENT.

BACKGROUND OF THE INVENTION

1. Field of the Invention

The present invention relates to the field of electronics, especially flexible electronic sheets, more especially flexible electronic sheets having image display capability, and the use of such sheets in gaming tables in communication with a processor or random number generator.

2. Background of the Art

Gaming table technology is advancing more and more towards electronic implementation of table games, even to a point here the dealer is virtual, the random events are visually displayed on display screens and credit is entered and awarded through electronic accounting and even e-Wallets. The following technical disclosures, which along with all documents cited herein are incorporated in their entireties by reference, include US Patent Publications and Patents. U.S. Pat. Nos. 8,926,421; 8,348,747; 8,147,316; and 7,758,411 and Published Applications Nos. 20060189365 (PokerTek) describe fully electronic tables with virtual playing cards, electronic wagering and even no live dealer. Multiple players have individual active screens displaying event outcomes and enabling wagers. U.S. Design Patent D512,466 shows a table layout with individual player panels that display individual player cards and provide individual player inputs on wagers and discards.

Published US Patent Application Documents Nos. 20120157193 and 20100130280 (Arezina) describe a multiplayer gaming system that senses multiple simultaneous contacts on a surface of a gaming table, differentiating contacts by different players. Privacy controls selectively display private information visible to only one of the players on or near the display surface of the gaming table. The gaming system also detects physical objects placed on the surface of the gaming table, causing wagering game functions or peripheral functions to be performed as a result of the placement of the object on the display surface.

Other systems emphasize control of playing cards and reading playing card and hand ranks. Published US Patent Application Documents No. 20100019449 (Downs) describes a playing card delivery shoe is used in the play of the casino table card game of baccarat or blackjack or any game where cards are pulled one at a time from the shoe. The apparatus comprises a reader or an imager that scans lines bisecting the image at spaced intervals. The scanning occurs on playing cards in at least the region where suit and rank symbols are provided. The scanner output is a series of voltages that are converted to binary information. This binary information is compared to stored binary information to determine rank and suit. The upper surface of the output end of the shoe contains a partial barrier for cards being scanned. The partial barrier has an elevated surface and limits a size of a pathway so that only one card can be removed at a time. The table surface defines a number of regions such that when the player tracking card is placed in a predefined region, a predetermined function is carried out.

Published US Patent Application Documents No. 20110275432 (Lutnick) describes an apparatus comprising: a machine readable medium having stored thereon a plurality of instructions that when executed causes a computing device to perform a method comprising: receiving a first wager by a first player on an outcome of a first poker game; determining a first set of hold cards for the first poker game; presenting the first set of hold cards to the first player; receiving a second wager by the first player on only the flop of the first poker game, in which the second wager may be won and lost independently of the first wager, in which the second wager includes a wager that the flop will include at least one characteristic; determining the flop of the first poker game; presenting the flop to the first player; determining whether the second wager is a winning wager based on whether the flop includes the characteristic; presenting an indication of whether the second wager is a winning wager; determining whether the first wager is a winning wager; and presenting an indication of whether the first wager is a winning wager. A software application may use an API associated with a pressure sensor to retrieve data from the sensor, e.g., data about the weight of chips placed over the sensor.

Published US Patent Application Documents No. 20150087417 (George) describes a system for use in operating gaming tables within a gaming environment is described herein. The system includes a user computing device including a display device, an imaging device for capturing and transmitting video images of an observation area within the gaming environment, and a system controller coupled to the user computing device and the imaging device. The system controller is configured to receive a live video image including a gaming table, display the live video image within a display area on the display device, and display an event area within the display area overlaying a portion of the gaming table image.

Published US Patent Application Document No. 20140370980 (Czyzewski) describes gaming assemblies with a playing surface including at least one screen display. A system projects visual light on the screen display. A radiation source illuminates objects placed over the screen display. A radiation sensor senses at least a portion of the objects placed over the screen display. A control circuit utilizes data from the radiation sensor. Methods of operating gaming tables and wagering game systems may include such gaming assemblies. A method of operating the gaming table, includes: projecting with a system an image onto a rear side of a screen display positioned proximate a playing surface of a gaming table to enable viewing of the image on a front side of the screen display; illuminating the rear side of the screen display with radiation from a radiation source located at the rear side of the screen display, wherein the screen display is at least partially translucent to the radiation to enable at least a portion of the radiation to reflect from an object placed proximate the front side of the screen display; receiving the at least a portion of reflected radiation at a radiation sensor;

generating digital data corresponding to the portion of reflected radiation received at the radiation sensor; and determining that the object is present on the top side of the screen with a control circuit configured to receive the digital data.

Published US Patent Application Document No. 20140349726 (Bucholz) describes a method for presenting the appearance of altered game outcome. In some embodiments, the operations can include presenting, by an electronic wagering game table, a wagering game including a game piece. The operations can also include determining a result for the wagering game. The operations can also include receiving first player input to move the game piece to reveal the result. The operations can also include presenting, on a display device, movement of the game piece. The operations can also include receiving, by the electronic wagering game table, second player input to alter the movement of the game piece, wherein alteration of the movement of the game piece appears to modify the result for the wagering game. The operations can also include presenting, in response to the second player input, altered movement of the game piece and the result for the wagering game.

A series of U.S. Patents with a common inventor of Soltys (including by way of non-limiting examples, U.S. Pat. Nos. 7,575,234; 7,510,194; 7,427,234; 7,390,256; 7,317,615; 7,222,852; 7,011,309; 6,991,544; 6,964,612; 6,857,961; 6,758,751; 6,712,696; and 6,688,979) describes various components and methods attempting to configure and establish a more automated gaming table.

Although these technologies provide useful gaming technologies and platforms, further improvements are needed.

SUMMARY OF THE INVENTION

A flexible carrier sheet enables a method of providing image content to individual ones of multiple player positions. The carrier sheet is a flexible, replaceable gaming table covering that includes a flexible carrier sheet. The flexible carrier sheet having multiple flexible electronic display panels capable of displaying distinct image content selected from the group consisting of: a) alphanumerics, b) distinct areas of light; and distinct areas of color, each of the multiple flexible electronic display panels provided on a top surface of the carrier sheet. One end of the electrically conductive leads go into each one of the flexible electronic display panels. An opposite end of the electrically conductive leads having at least one connector configured to receive electronic data input so that the electrically conductive leads transmit the electronic data input to each one of the flexible electronic display panels. A dealer or sensor may initiate a command, or a command is automatically provided to at least one of the flexible electronic display panels to display a particular image that preferably does not include a virtual image of a playing card.

DETAILED DESCRIPTION OF THE INVENTION

Figure 1:
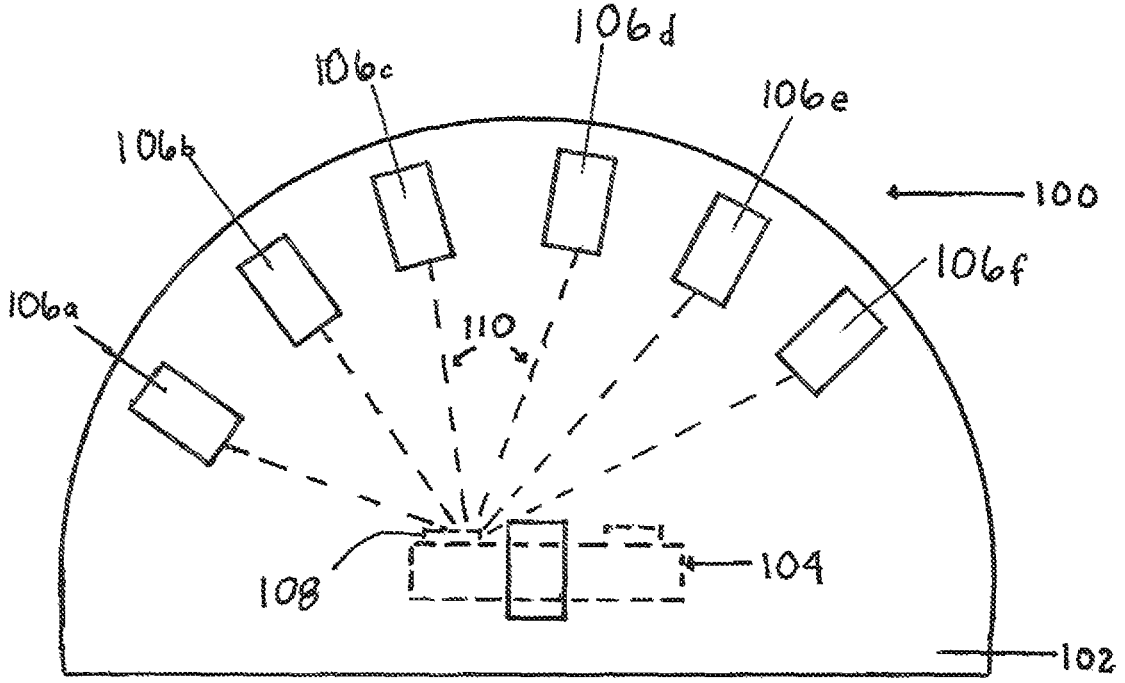
FIG. 1 shows a table top "felt" cover sheet with multiple flexible electronic display panels embedded into the sheet and connected in parallel to a command element.

The present technology relates to methods and apparatus that enables execution of the method. A flexible, replaceable gaming table covering within the present technology includes a flexible carrier sheet. The flexible carrier sheet has multiple flexible electronic display panels capable of displaying distinct image content selected from the group consisting of: a) alphanumerics, b) distinct areas of light; and distinct areas of color, each of the multiple flexible electronic display panels provided on a top surface of the carrier sheet. One end of electrically conductive leads going into each one of the flexible electronic display panels and an opposite end of the electrically conductive leads having at least one connector configured to receive electronic data input so that the electrically conductive leads transmit the electronic data input to each one of the flexible electronic display panels. The panels may be flush with a main table covering material. For example, many "felts" used as coverings are polymeric or elastomeric sheet material having a fabric layer or coating on its top surface. It is a simple matter, according to the present invention to patch the flexible electronic display panels into the fabric to make a flush table top cover with a smooth transition from the felt to the panels. The felt and the panel may be secured by stitching, stapling, fusing, adhesive or by patches overlaying a seam area between the felt and the panel, for example, to keep top surfaces of the different materials flush. The electrical connections may be embedded in the felt material. As the electrical connection may be relatively thin, a groove may be cut into the felt base to prevent ridges or bumps. Grooves may also be cut into the gaming table top, the electronic communication links built into the table, and the felt lain over the electrical communication links, with pin connector, snaps or other acceptable information transmission connectors. Single pin, multiple pins, multiple plugs, oriented snaps, I/O ports and the like are particularly useful, but any connector enabling communication between the command emitter (processor, random number generator, FPGA or ASIC) and the distinguishable individual panels. The "replaceable" aspect of the technology is also noteworthy. When changing games on non-electronic gaming tables, the house generally needs to replace only the felt. In the present technology, even with electronically supplemented gaming events, by having a replaceable felt with electronics embedded therein that can connect to underlying electronics (e.g., command element, processor, random number generator, chip board, FPGA, ASIC, power source) by laying down a new game felt and connecting the respective electronics.

In the gaming table covering, each one of the flexible display panels may have a serially or parallel electrically conductive lead attached to the at least one connector. The connector is in electrical communication with a command device selected from the group consisting of a processor, random number generator, field programmable gated array, application specific integrated circuit and logic circuit. The command device may initiate the commands (to display specific alphanumerics, light areas, colored areas or any display enabled by the panels and indicated by the command, although specific playing card images are the least desirable and may be excluded from memory or a library available to the command element) as a result of various command situations. Among the bases for emitting commands are dealer input (e.g., through buttons, a panel, voice commands, touchscreen or other dealer input controls), automated situational commands (e.g., automated recognition of wager placement with a signal to the command element, dealing of at least one playing card with card delivery communicated to the command element, specific player action such as placement of an electronic wager, or other sensed gaming events communicated to the command element which issues and transmits the image data or image command to the respective panel. Communication of the command element to a card reading system (in a shuffler, dealer shoe or tray, table reading, overhead reading or any other card reading system that can indicate individual cards or sets of cards delivered to player and/or dealer positions can be used to initiate commands when specific cards or hands are read and delivered to specific positions. The panels may have a memory chip/storage in the panels so that a specific command generates a specific image display. As these panels do not need an infinite number of images but may have as few as one and often only 2, 3, 4, 5 or 6 images to select from, only aa small amount of memory may be needed The gaming table covering may have each of the multiple flexible electronic display panels with a processor recognizable identity distinct for every other ones of the multiple flexible electronic display panels. In this way, neither serial communications nor parallel communications can send wrong signals to inappropriate panels.

As noted, the gaming table covering may be fixed to a surface of a gaming table wherein the connector is electrically connected to a command device selected from the group consisting of a processor, random number generator, field programmable gated array (FPGA), application specific integrated circuit (ASIC) and any other logic circuit. It preferred that the gaming table covering is fixed to a surface of a gaming table wherein the connector is electrically connected to a command device selected from the group consisting of a processor, random number generator, field programmable gated array, and application specific integrated circuit.

The gaming table covering may require that each of the multiple flexible electronic display panels has an area dedicated to display of only a single invariable image. For example, an area may indicate "wager placed," "wagers locked," "side bet accepted," "bonus active," and the like.

A method according to the present invention provides image content to individual ones of multiple player positions on a flexible, replaceable gaming table covering as described above. A dealer or sensor initiates a command to at least one of the flexible electronic display panels to display a particular image that does not include a virtual image of a playing card. The command to at least one of the flexible electronic display panels to display a particular image is sent before, during or after any random event outcome is provided to any player position here there is at least one of the flexible electronic display panels.

The flexible carrier sheet having multiple flexible electronic display panels can be manufactured using technology that has been used in fields of technology other than gaming table methods as described herein. Such technology disclosures as presented below are incorporated herein by reference in the following content.

U.S. Pat. No. 9,765,934 (Rogers) provides electronic devices including arrays of printable light emitting diodes (LEDs) having device geometries and dimensions providing enhanced thermal management and control relative to conventional LED-based lighting systems. The systems and methods described provide large area, transparent, and/or flexible LED arrays useful for a range of applications in microelectronics, including display and lightning technology. Methods are also provided for assembling and using electronic devices including thermally managed arrays of printable light emitting diodes (LEDs).

U.S. Pat. No. 9,761,444 (Nuzzo) discloses methods and devices for fabricating and assembling printable semiconductor elements and assembling printable semiconductor elements onto substrate surfaces. Methods, devices and device components of the present invention are capable of generating a wide range of flexible electronic and optoelectronic devices and arrays of devices on substrates comprising polymeric materials. The present invention also provides stretchable semiconductor structures and stretchable electronic devices capable of good performance in stretched configurations.

U.S. Pat. No. 9,741,785 (Bower) discloses a display tile structure includes a tile layer with opposing emitter and backplane sides. A light emitter having first and second electrodes for conducting electrical current to cause the light emitter to emit light is disposed in the tile layer. First and second electrically conductive tile micro-wires and first and second conductive tile contact pads are electrically connected to the first and second tile micro-wires, respectively. The light emitter includes a plurality of semiconductor layers and the first and second electrodes are disposed on a common side of the semiconductor layers opposite the emitter side of the tile layer. The first and second tile micro-wires and first and second tile contact pads are disposed on the backplane side of the tile layer.

U.S. Pat. No. 9,720,449 (Ko) describes a flexible display device including a touch sensor is disclosed. In one aspect, the display device includes a flexible substrate, a light emission layer formed over the flexible substrate, and an encapsulation layer formed over the light emission layer and comprising a plurality of encapsulating thin films and a touch detecting layer configured to detect a touch input. The encapsulating thin films include at least one inorganic film and at least one organic film and the touch detecting layer is interposed between a selected one of the at least one inorganic film and a selected one of the at least one organic film that are adjacent to each other.

U.S. Pat. No. 9,666,833 (Gao) describes an array substrate and a manufacturing method thereof, a flexible display panel and a display device are provided. The array substrate includes a flexible substrate divided into a display region and a periphery region, the periphery region surrounding the display region. The array substrate further includes: an array layer and a first film layer sequentially formed in the display region on the flexible substrate; a plurality of integrate circuits and a flexible printed circuit board interface formed in the periphery region on the flexible substrate; a flexible protective film layer formed on a junction of the periphery region and the first film layer and in a region of the periphery region other than the integrate circuits and the flexible printed circuit board interface on the flexible substrate.

U.S. Pat. No. 9,647,171 (Rogers) describes printed assemblies of ultrathin, microscale inorganic light emitting diodes for deformable and semitransparent displays including printable structures and methods for making, assembling and arranging electronic devices. A number of the methods described herein are useful for assembling electronic devices where one or more device components are embedded in a polymer which is patterned during the embedding process with trenches for electrical interconnects between device components. Some methods described herein are useful for assembling electronic devices by printing methods, such as by dry transfer contact printing methods. Also described herein are GaN light emitting diodes and methods for making and arranging GaN light emitting diodes, for example for display or lighting systems.

U.S. Pat. No. 9,623,342 (Kim) describes a display apparatus that includes a display panel including a substrate including a display region in which a display unit is located, a non-display region that extends outward from the display region and in which a plurality of pads are located, and a sealing portion that covers the display unit. The display apparatus also includes a circuit board including a flexible film and a plurality of terminals on the flexible film that are electrically coupled to the plurality of pads. The plurality of pads are spaced from each other along a first direction of the display panel and pad central points of the plurality of pads are located at at least two different locations along the first direction.

U.S. Pat. No. 9,613,911 (Rogers) provides electronic circuits, devices and device components including one or more stretchable components, such as stretchable electrical interconnects, electrodes and/or semiconductor components. Stretchability of some of the present systems is achieved via a materials level integration of stretchable metallic or semiconducting structures with soft, elastomeric materials in a configuration allowing for elastic deformations to occur in a repeatable and well-defined way. The stretchable device geometries and hard-soft materials integration approaches of the invention provide a combination of advance electronic function and compliant mechanics supporting a broad range of device applications including sensing, actuation, power storage and communications.

U.S. Pat. No. 9,601,671 (Rogers) provides optical devices and systems fabricated, at least in part, via printing-based assembly and integration of device components. In specific embodiments the present invention provides light emitting systems, light collecting systems, light sensing systems and photovoltaic systems comprising printable semiconductor elements, including large area, high performance macroelectronic devices. Optical systems of the present invention comprise semiconductor elements assembled, organized and/or integrated with other device components via printing techniques that exhibit performance characteristics and functionality comparable to single crystalline semiconductor based devices fabricated using conventional high temperature processing methods. Optical systems of the present invention have device geometries and configurations, such as form factors, component densities, and component positions, accessed by printing that provide a range of useful device functionalities. Optical systems of the present invention include devices and device arrays exhibiting a range of useful physical and mechanical properties including flexibility, shapeability, conformability and stretchability.

U.S. Pat. No. 9,589,529 (Kim) describes a device enabling for a user to control a flexible display more convenient and precise and a controlling method therefore. The device includes aflexible display, a length measuring unit configured to measure an expanded length of the flexible display expanded from the device, a speed measuring unit configured to measure a speed of which the flexible display expanded from the device and a processor configured to control the flexible display, the length measuring unit, and the speed measuring unit, wherein if the flexible display is expanded to a unit length, the processor displays an application execution screen corresponding to the unit length in the flexible display.

U.S. Pat. No. 9,583,428 (Rafferty) provides systems and methods for the embedding of thin chips. A well region is generated in a substrate that includes a conductive material disposed on a flexible polymer. The standoff well region can be generated by pattern the conductive material, where the thin chip is embedded in the standoff well region. A cavity can be generated in the polymer layer to form a polymer well region, where the thin chip is embedded in the polymer well region.

U.S. Pat. No. 9,436,035 (McRae) describes a display system, with a structural part, including a rear panel, and a light emitting device physically attached to the rear panel over a surface of the rear panel, where the surface of the rear panel comprises the entire surface to be illuminated by the light emitting device and a pixelated spatial light modulator part, coupled between the light emitting device, and a viewing area, modulating a light created by said light emitting device.

A further description of a method according to the present technology includes a method of providing image content to individual ones of multiple player positions on a flexible, replaceable gaming table covering comprising:

a flexible carrier sheet;

the flexible carrier sheet having multiple flexible electronic display panels capable of displaying distinct image content selected from the group consisting of: a) alphanumerics, b) distinct areas of light; c) symbols; and d) distinct areas of color, each of the multiple flexible electronic display panels provided on a top surface of the carrier sheet;

one end of electrically conductive leads attached to the flexible, replaceable gaming table covering and electronically connected to each one of the flexible electronic display panels; and an opposite end of the electrically conductive leads having at least one connector configured to receive electronic data input so that the electrically conductive leads transmit the electronic data input to each one of the flexible electronic display panels;

wherein a dealer, processor, playing card delivery device or sensor initiates a command to at least one of the flexible electronic display panels to display a particular image that does not include a virtual image of a playing card.

FIG. 1 shows a table top "felt" cover sheet 100 with multiple flexible electronic display panels 106*a-f* embedded into the sheet 100 and connected in parallel to a command element 104. Each individual flexible electronic panel display element 106*a*, 106*b*, 106*c*, 106*d*, 106*e* and 106*f* is connected through a conductive link 110 (which may be a wireless link, but that is less preferred because of security) in parallel to a connector 108 (pin box, I/O port, multiple I/O ports, etc.) on the command component 104 (computer, processor, random number generator, field programmable gated array, application specific integrated circuit, or other logic device that sends a command or image content to the individual ones of the multiple flexible electronic display panels 106*a-f*.

Figure 2:
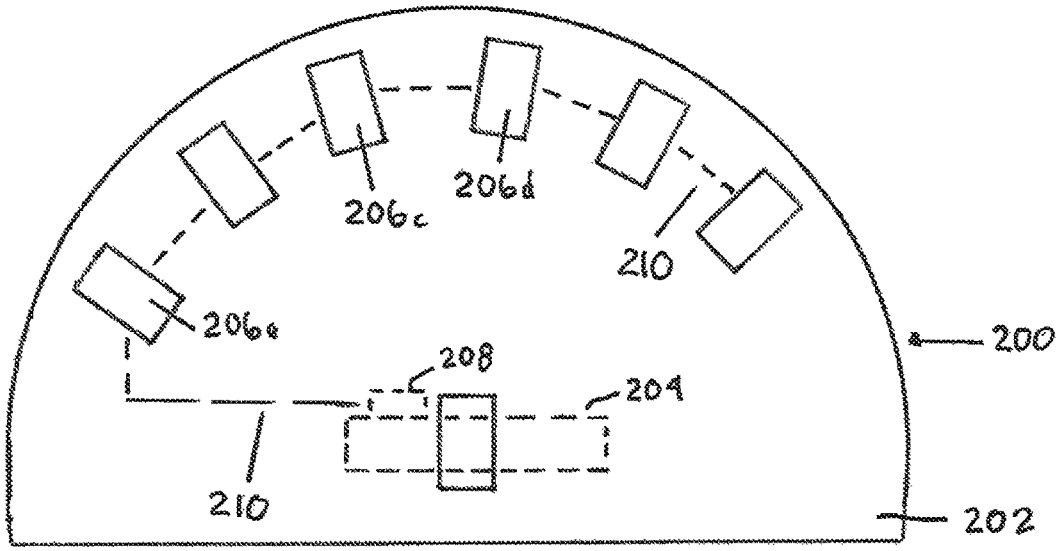
FIG. 2 shows a table top "felt" cover sheet with multiple flexible electronic display panels embedded into the sheet and connected in seriality to a command element.

FIG. 2 shows a table top "felt" cover sheet 200 with multiple flexible electronic display panels (e.g., 206*a*, 206*c* and 206*d*) embedded into the sheet 200 and connected through continuous serial link 210 in seriality to a command element 204 through a connector, e.g., I/O port 208. In this format, it is necessary for ach of the individual ones of the multiple flexible electronic display panels (e.g., 206*a*, 206*c* and 206*d*) have an address or name so that commands from the command element 204 is read by the appropriately named panel in the command. It is to be noted that the command element may have dealer input (not shown) through buttons, touchscreens, switches, and other data entry mechanisms to provide the appropriate signals to each named multiple flexible electronic display panels. In some simpler gaming elements, there may be data entry with buttons identifying the player position which are pressed to provide a single command, and pressing the single button dedicated to each player position sends that single signal to the named position. In other circumstances, where random events are provided to each player position, a dealer button (not shown) may be pressed and the random commands sent to each respective player position.

Figure 3:
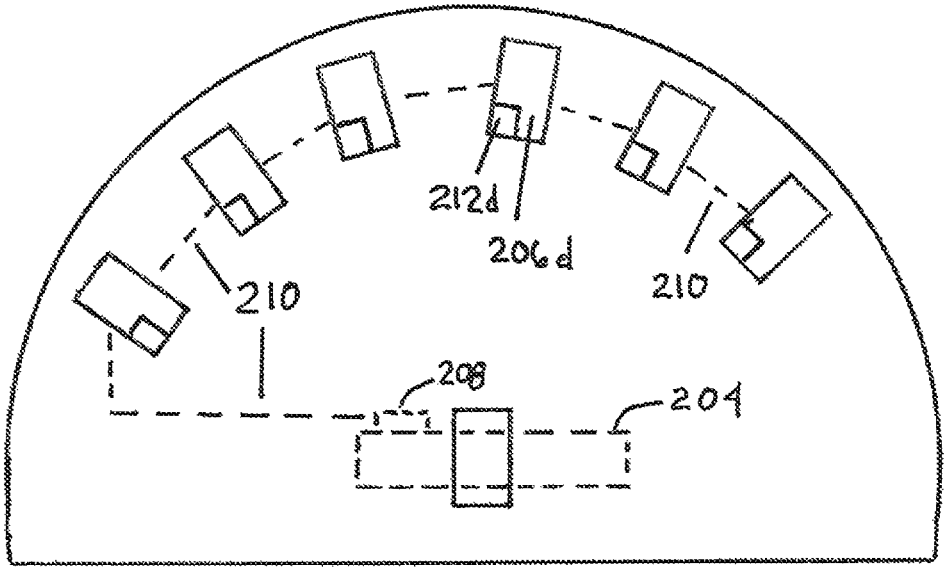
FIG. 3 shows a table top "felt" cover sheet with multiple flexible electronic display panels embedded into the sheet and connected in seriality to a command element, each display panel showing an area with a dedicated and sole image capacity.

FIG. 3 shows a table top "felt" cover sheet 200 with multiple flexible electronic display panels (e.g., 206*a*, 206*c* and 206*d*) embedded into the sheet 200 and connected in seriality to a command element 204 through the connector 208, each display panel showing an area with a dedicated and sole image capacity (e.g., (e.g., 212*a*, 212*c* and 212*d*).

Figure 3A:
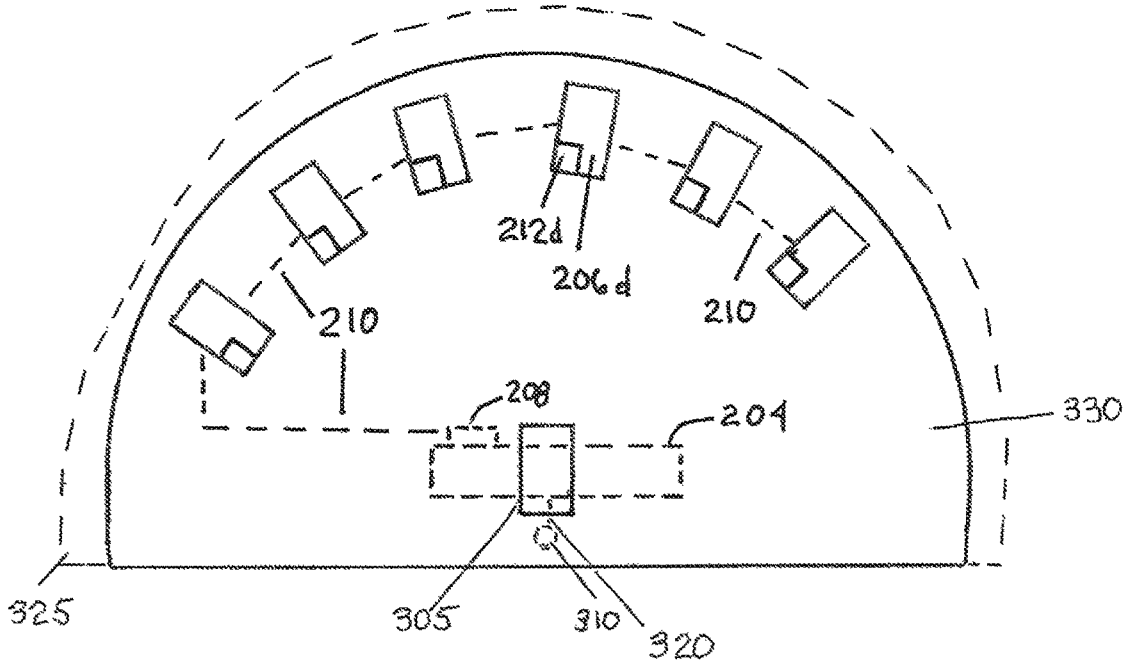
FIG. 3A shows a table top "felt" cover sheet with multiple flexible or inflexible electronic display panels embedded into the sheet and connected in seriality to a command element, each display panel showing an area with a dedicated and sole image capacity.

FIG. 3A (with all identical numbers from FIG. 3 representing same or as explained in greater detail similar functioning elements here) shows a table top "felt" cover sheet 200 with multiple flexible or inflexible electronic display panels 106*a*, 106*b*, 106*c*, 106*d*, 106*e* and 106*f* embedded into the sheet 200 and connected in seriality to a command element 204, each display panel showing an area 212*d* with a dedicated and sole image capacity. Although this description of novel and unobvious technology has emphasized benefits of the flexible electronic display panels, there is an alternative variant with benefits over other prior art. The electronic display panels may be thin enough (e.g., less than 1.5 cm) to be embedded in the polymeric or elastomeric sheet material, which will still be flexible enough to be fit comfortably onto a gaming table top (not shown). In fact, as explained in some detail in of U.S. patent application Ser. No. 14/829,800, filed 19 Aug. 2015 cited above, the entire table top panel substrate 330 may be rigid, with the multiple flexible or inflexible electronic display panels 106*a*, 106*b*, 106*c*, 106*d*, 106*e* and 106*f* being thin enough to provide only allowable surface deformations to a gaming table. The more rigid (or still flexible) table top 330 can then be placed onto the gaming table, and the snap-in/pin connector 310 in communication link 320 with the processor 204 engaged by the placement of the rigid or flexible electronic display panels 106*a*, 106*b*, 106*c*, 106*d*, 106*e* and 106*f*. A dealer display panel (flexible or inflexible) 305 is also shown. As gaming table structures may vary in size, each table top panel 330 may not fit every table perfectly. To assist in making the table top structures (especially where rigid) fit and provide a quality appearance, a skirt 325 of fabric or flexible material matching the appearance of the remainder of the table top structure 330 may surround some or all of the edges of the table top structure 330 (including the dealer position adjacent the snap-in/pin connector 310). The snap-in/pin connector 310 is shown below the table top surface 330, but may extend parallel to the table top structure 330, facing the dealer and slide into an electronic communication system for the processor 204 which may be in the table (not shown) and not a part of the flexible electronic panel bearing replaceable system of the present technology. Having the command element 204 as a separate part of the entire table (as opposed to being part of the replaceable felt table top system is actually preferred. This is so, even though such processor/random number generator/FPGA/ASIC systems have become sufficiently miniaturized as to be carried on the felt component. The only needed connection (if there were no power source in the felt component) to the table besides structural securement would be engagement with a power source (battery, power line, outlet, etc.) available to the table. This power requirement applies to all structures of the present technology, which clearly require power.

Figure 4:
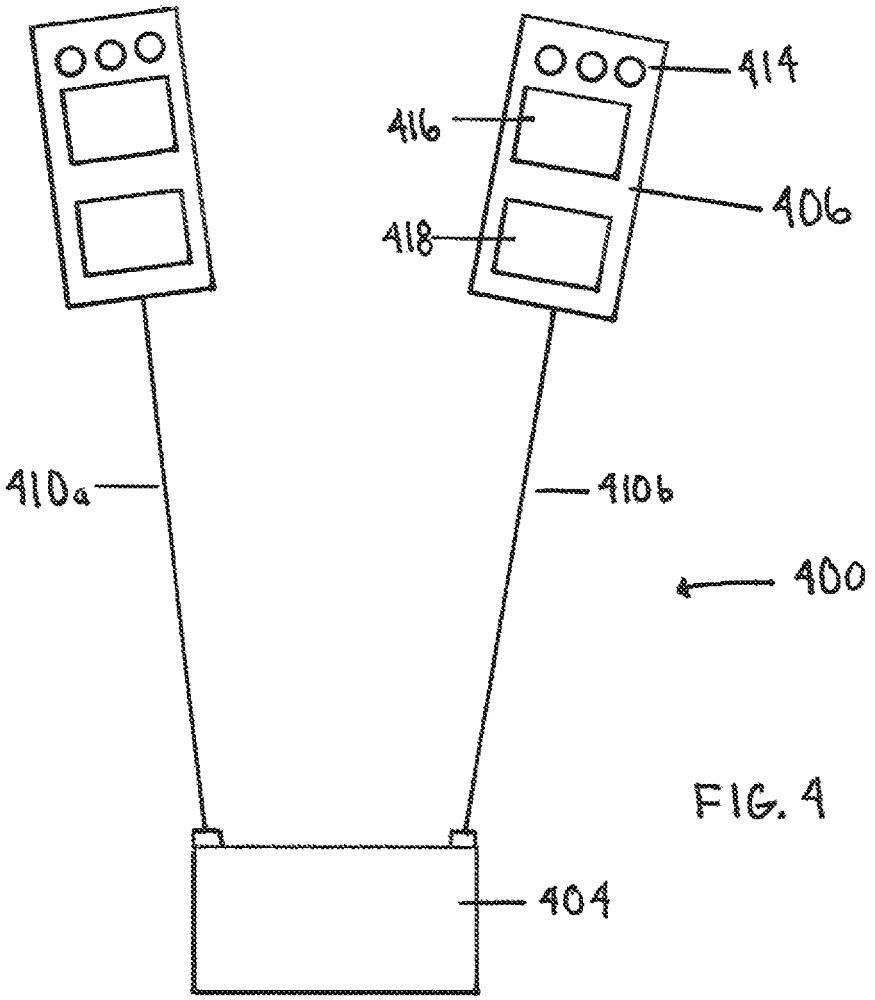
FIG. 4 shows two flexible electronic display panels connected to a command element such as a processor or random number generator.

FIG. 4 shows a system 400 having two flexible electronic display panels 406 connected to a command element 404 such as a processor or random number generator. Each panel 406 is shown with different types of individual panel displays responses. Multiple lighting areas 414 (with the same or different color light responses in each of the three areas of 414 shown), a panel display 416 which may have digital or analog imaging, seven-segment displays, LED panels, liquid crystal displays, single image capability (e.g., signage) and the like, and possibly an inverted dealer friendly panel 418 providing similar image content to the dealer as panel 416 provides to a player.

Figure 5:
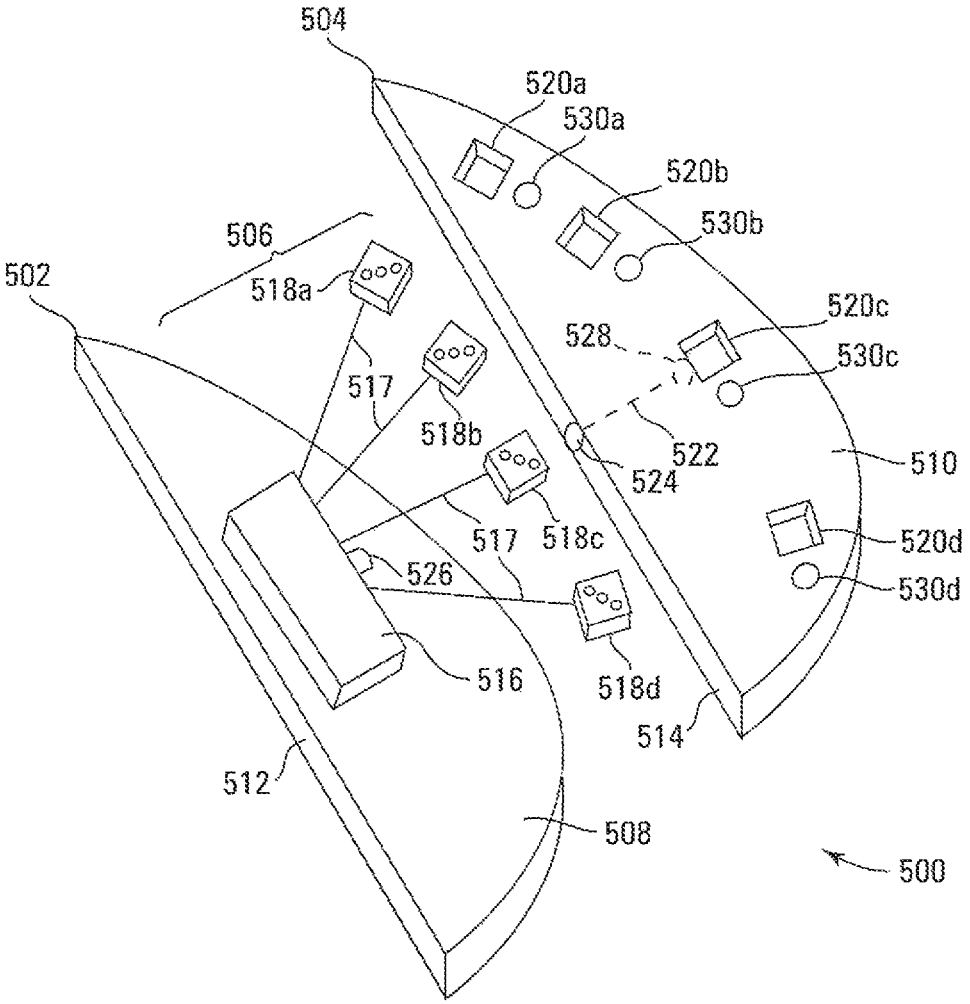
FIG. 5 (PRIOR ART)
FIG. 5 (Prior Art of Applicant from PCT Application) shows a perspective exploded view of a gaming table including a four-channel secondary random event generator of the present technology and possibly non-flexible panels inserted into a felt gaming table top.

FIG. 5 (Prior Art of Applicant from PCT Application) shows a perspective exploded view of a gaming table system 500 including a four-channel secondary random event generator 526 of the present technology and possibly non-flexible panels 518*a-d* inserted into a felt gaming table top.

It is often important in industry to provide a more versatile system that is highly flexible, easily configured to multiple uses, and simple to construct. This engineering principle 5 is emphasized in FIG. 5, which shows a perspective exploded view of a gaming table system 500 including a four-channel secondary random event generator 526 of the present technology. Again, four channels are shown to simplify the Figure, whereas 2-10 channels 9 for example) may be provided on a table, and preferably 5-8 player channels and at most one dealer channel may be 10 provided. The gaming table system 500 is shown with a base support layer 502 and a gaming table top cover layer 504. The base support layer 502 has an edge facing 512 that would face the dealer (not shown) and an upper support surface 508. The upper support surface 508 carries the secondary random number generator and any included circuitry 516 necessary for relaying the secondary random number generator events. The circuitry may be supported by a wireless 15 output component or I/O connection port 526 as integrated or not into the system 500. The secondary random number generator and any included circuitry 516 is shown to be wired to four separate and distinct individual player position visual output devices 518*a*, 518*b*, 518*c* and 518*d* by individual dedicated wires 517 to form an insertable secondary random event generation component 506 which includes all elements of 516, 517, 518*a-d* and 526 (where used). Where 20 there are fewer or more player positions, there would be fewer or more visual output devices such as 518*a-d* and possibly a dealer visual output device in communication with the secondary random number generator and any included circuitry 516.

The table top cover layer 504 is supported by a table structure (e.g., ridges on a table, not shown) and provides a gap between the surfaces 510 of the table top cover layer 504 and the base 25 support layer 502 which has an edge facing 512 that would face the dealer (not shown) and an upper support surface 508. The gap or spacing allows placement of the (as shown) elevated secondary random number generator and any included circuitry 516 and its associated output component or I/O connection port 526 (if present), and the (as shown, but not limiting) four separate and distinct individual player position visual output devices 518*a*, 518*b*, 518*c* and 518*d* by individual dedicated wires 517 that form the insertable secondary random event generation component 506. The separate and distinct individual player position visual output devices 518*a*, 518*b*, 518*c* and 518*d* are respectively positioned so as to be exposed through holes or openings 520*a*, 520*b*, 520*c* and 520*d* in the table top cover layer 504. Each separate and individual player position is also shown with a side bet or jackpot bet sensing/entering input system 5 as 530*a*, 530*b*, 530*c* and 530*d*, respectively. An alternative construction may include a wireless or wired communication port 524 in linked communication path 522 to an individual opening (520*c* is exemplified, but paths would be to each separate and distinct individual player position visual output devices 518*a*, 518*b*, 518*c* and 518*d* as by a further direct connecting port 528 to each 10 separate and distinct individual player position visual output devices 518*a*, 518*b*, 518*c* and 518*d*.

The communication links/wires 517 are shown in a parallel arrangement, but as each of the separate and distinct individual player position visual output devices 518*a*, 518*b*, 518*c* and 518*d* would have its own identity, the communication link could alternatively be serial or by wireless communication.

The term flexible as used herein is defined as the sheet (or the individual panel) having the ability to be wrapped over a twelve inch (30.5 cm) diameter cylinder and held in place for one minute without cracking. If the panel is smaller than 12 inches, it should still be capable of conforming to the surface of the 30.5 inch diameter cylinder without cracking. Preferred flexible elements can conform to a 15.2 cm diameter cylinder (6-inches). Even more flexible elements can be provided which are capable of conforming to the surface of a 6-inch inch (15.2 cm) diameter cylinder and held in place by manual force for fifteen minutes without cracking.

The carrier for the panels should be flexible, such as materials presently used to form casino table felts. The preferred carriers are fabrics, polymers, elastomers, foams and laminates and blends of these materials, which in combination remain flexible. Although specific materials and structures are defined herein to enable the generic invention, those specifics are not intended to limit the scope of the appended claims.

What is claimed:

1. A flexible, replaceable gaming table covering comprising:

a flexible carrier sheet able to be wrapped over a twelve inch diameter cylinder and held in place for one minute without cracking;

the flexible carrier sheet having multiple flexible electronic display panels capable of displaying distinct image content selected from the group consisting of: a) alphanumerics, b) distinct areas of light; and distinct areas of color, each of the multiple flexible electronic display panels provided on a top surface of the flexible carrier sheet;

one end of electrically conductive leads going into each one of the multiple flexible electronic display panels; and an opposite end of the electrically conductive leads having at least one connector configured to receive electronic data input so that the electrically conductive leads transmit the electronic data input to each one of the multiple flexible electronic display panels.

2. The flexible, replaceable gaming table covering of claim 1 wherein each one of the multiple flexible electronic display panels has a parallel electrically conductive lead attached to the at least one connector.

3. The flexible, replaceable gaming table covering of claim 2 wherein the at least one connector is in electrical communication with a command device selected from the group consisting of a processor, a random number generator, a field programmable gated array, an application specific integrated circuit and a logic circuit.

4. The flexible, replaceable gaming table covering of claim 3 wherein each of the multiple flexible electronic display panels has a processor recognizable identity distinct for every other ones of the multiple flexible electronic display panels.

5. The flexible, replaceable gaming table covering of claim 2 wherein each of the multiple flexible electronic display panels has a processor recognizable identity distinct for every other ones of the multiple flexible electronic display panels.

6. The flexible, replaceable gaming table covering of claim 5 fixed to a surface of a gaming table wherein the at least one connector is electrically connected to a command device selected from the group consisting of a processor, a random number generator, a field programmable gated array, and an application specific integrated circuit.

7. The flexible, replaceable gaming table covering of claim 2 fixed to a surface of a gaming table wherein the at least one connector is electrically connected to a command device selected from the group consisting of a processor, a random number generator, a field programmable gated array, an application specific integrated circuit and a logic circuit.

8. The flexible, replaceable gaming table covering of claim 7 wherein each of the multiple flexible electronic display panels has an area dedicated to display of only a single invariable image.

9. The flexible, replaceable gaming table covering of claim 1 wherein each one of the multiple flexible electronic display panels has a serially connected electrically conductive lead attached through adjacent ones of the multiple flexible electronic display panels to the at least one connector.

10. The flexible, replaceable gaming table covering of claim 9 wherein the at least one connector is in electrical communication with a command device selected from the group consisting of a processor, a random number generator, a field programmable gated array, an application specific integrated circuit and a logic circuit.

11. The flexible, replaceable gaming table covering of claim 10 wherein each of the multiple flexible electronic display panels has a processor recognizable identity distinct for every other ones of the multiple flexible electronic display panels.

12. The flexible, replaceable gaming table covering of claim 9 wherein each of the multiple flexible electronic display panels has a processor recognizable identity distinct for every other ones of the multiple flexible electronic display panels.

13. The flexible, replaceable gaming table covering of claim 12 fixed to a surface of a gaming table wherein the at least one connector is electrically connected to a command device selected from the group consisting of a processor, a random number generator, a field programmable gated array, and an application specific integrated circuit.

14. The flexible, replaceable gaming table covering of claim 9 fixed to a surface of a gaming table wherein the at least one connector is electrically connected to a command device selected from the group consisting of a processor, a random number generator, a field programmable gated array, an application specific integrated circuit and a logic circuit.

15. The flexible, replaceable gaming table covering of claim 1 wherein the at least one connector is in electrical communication with a command device selected from the group consisting of a processor, a random number generator, a field programmable gated array, an application specific integrated circuit and a logic circuit.

16. The flexible, replaceable gaming table covering of claim 15 wherein each of the multiple flexible electronic display panels has a processor recognizable identity distinct for every other ones of the multiple flexible electronic display panels.

17. A method of providing image content to individual ones of multiple player positions on a flexible, replaceable gaming table covering able to be wrapped over a twelve-inch diameter cylinder and held in place for one minute without cracking comprising:

a flexible carrier sheet;

the flexible carrier sheet having multiple flexible electronic display panels embedded into the flexible carrier sheet, each of the multiple flexible electronic display panels able to be wrapped over a twelve inch diameter cylinder and held in place for one minute without cracking and the multiple flexible electronic display panels capable of displaying distinct image content selected from the group consisting of: a) alphanumerics, b) distinct areas of light; c) symbols; and d) distinct areas of color, each of the multiple flexible electronic display panels provided on a top surface of the flexible carrier sheet;

one end of electrically conductive leads attached to the flexible, replaceable gaming table covering and electronically connected to each one of the multiple flexible electronic display panels; and an opposite end of the electrically conductive leads having at least one connector configured to receive electronic data input so that the electrically conductive leads transmit the electronic data input to each one of the multiple flexible electronic display panels;

wherein a dealer, a processor, a playing card delivery device or a sensor initiates a command to at least one of the multiple flexible electronic display panels to display a particular image that does not include a virtual image of a playing card.

18. The method of claim 17 wherein the command to the at least one of the multiple flexible electronic display panels to display the particular image is sent before any random event outcome is provided to any player position where there is the at least one of the multiple flexible electronic display panels.

19. The method of claim 17 wherein the command to the at least one of the multiple flexible electronic display panels to display the particular image is sent after at least one random event indicator is provided to any player position where there is the at least one of the multiple flexible electronic display panels.

* * * * *